United States Patent [19]

de Smet

[11] Patent Number: 5,067,336

[45] Date of Patent: Nov. 26, 1991

[54] DEVICE FOR PRESSING SHEET MATERIAL

[75] Inventor: Gabriel de Smet, Nogent sur Oise, France

[73] Assignee: Isoform, France

[21] Appl. No.: 458,169

[22] Filed: Dec. 28, 1989

[30] Foreign Application Priority Data

Dec. 30, 1988 [FR] France ..... 88 17525

[51] Int. Cl.[5] ..... B21D 22/12; B21D 26/00

[52] U.S. Cl. ..... 72/57; 72/63; 72/465; 29/421.1

[58] Field of Search ..... 72/56, 57, 60, 63, 465; 29/421.1

[56] References Cited

U.S. PATENT DOCUMENTS

| | | | |
|---|---|---|---|
| 2,422,883 | 6/1947 | Bruderlin | 72/60 |
| 2,719,500 | 10/1955 | Kraybill | 72/57 |
| 2,783,728 | 3/1957 | Hoffmann | 72/57 |
| 3,382,690 | 5/1968 | Achler et al. . | |
| 3,533,256 | 10/1970 | Hurek et al. . | |
| 3,748,889 | 7/1973 | Miller et al. . | |
| 4,770,015 | 9/1988 | de Smet | 72/63 |
| 4,833,903 | 5/1989 | DeSmet | 72/57 |

FOREIGN PATENT DOCUMENTS

| | | | |
|---|---|---|---|
| 0799869 | 1/1981 | U.S.S.R. | 72/465 |
| 1183-237 | 6/1983 | U.S.S.R. . | |

*Primary Examiner*—David Jones

*Attorney, Agent, or Firm*—Fay, Sharpe, Beall, Fagan, Minnich & McKee

[57] ABSTRACT

Device for pressing sheet material blanks, in particular sheet metal blanks (10), comprising a cushion (2) composed of an elastic material disposed in a retaining box (1), an arrangement for performing the sheet blank constituted by an outer slide carrying an upper blank holder (6), and an arrangement for finally forming the sheet blank constituted by a central slide acting on a punch (8), the device further comprising a lower blank blank holder constituted by an element (3) for supporting and maintaining at least a portion of the sheet blank (10), placed directly on the elastic cushion (2) and cooperative with the upper blank holder (6) for gripping the sheet blank in at least localized region of the blank.

19 Claims, 7 Drawing Sheets

DEVICE FOR PRESSING SHEET MATERIAL

The present invention relates to a device for pressing sheet material, in particular extra-thin metal sheets of large size.

A method for pressing on an elastic cushion is known from U.S. Pat. No. 4,833,903. In this method, the sheet to be formed is disposed on an elastic cushion, an outer slide carrying a blank holder is applied on the peripheral portion of the sheet so as to cause the flowing of the mass of the elastic cushion for the purpose of deforming the central portion of the sheet and impart thereto, at the end of the preforming step, a surface area substantially equal to the surface area of the finished part to be obtained, then a central slide acting through a punch is applied on the central portion of the sheet for the purpose of effecting the final shaping of the part.

This method permits the pressing of sheet material, in particular a material having a low elongation, which may be in particular a sheet of metal, for example steel, although the method is not limited to the pressing of sheet metal but may be applicable to plastics materials and any other composite material.

The cushion of elastic material is described as being in particular a composite support comprising a substantially parallel-sided mass based on a silicone elastomer having a low Shore hardness which may be covered on its upper surface and on the whole or on a part of its lateral surfaces with a relatively thin skin composed of a stronger and harder material.

This technique, in which the sheet is placed directly on the cushion of elastic material permits obtaining pressings having a substantially constant thickness, and is in particular of utility for extra-thin sheets; however, this method does not permit effectively opposing the formation of wrinkles in the highly shrunk regions, in particular the angular regions.

Indeed, in order to press-form parts having various and angular shapes, there must occur in these regions a large shrinkage whose tendency to form wrinkles can only be reduced by increasing the pressure exerted by the blank holder on the sheet. Now, with the technique disclosed in U.S. Pat. No. 4,833,903, the sheet is insufficiently maintained in the region under the blank holder, i.e. between the blank holder and the cushion of elastic material which does not in itself have sufficient rigidity.

Another drawback of this known technique resides in the surface degradation of the material constituting the elastic cushion in the region below the blank holder, which is prejudicial to the mass-production of parts.

A method for pressing on elastic cushion is also known from U.S. Pat. No. 4,770,015, in which the sheet blank to be formed is disposed on a support constituting a retaining box for the elastic cushion, a blank holder is applied on the peripheral portion of the blank sheet so as to achieve, in localized regions, the flanging of the edge portion of the sheet blank and cause the flowing of the mass of the elastic cushion for the purpose of deforming the central portion of the sheet blank, then a punch is applied on the central portion of the sheet blank so as to effect the final shaping of the part.

An object of the present invention is to overcome these drawbacks and to improve the effectiveness and prolong the life of the cushion of elastic material and possibly favour the total of partial flanging of the edge portion of the sheet blank so as to mass-produce pressed parts of medium depth, but of large size, such as automobile parts whose central portions practically never have shapes of revolution but represent non-developable complex shapes.

The invention therefore provides a device for pressing sheet material, in particular blanks of sheet metal, comprising a cushion composed of an elastic material disposed in a retaining box, means for preforming the sheet blank comprising an outer slide carrying an upper blank holder, means for effecting the final forming of said sheet blank comprising a central slide acting on a punch, said device further comprising a lower blank holder constituted by means for supporting and maintaining at least a portion of the sheet blank placed directly on the elastic cushion and cooperative with the upper blank holder for gripping at least localized regions of the sheet blank.

According to other features of the invention:

the supporting and maintaining means have a shaped surface profile corresponding to the profile of the peripheral region of the finished part to be obtained;

the supporting and maintaining means have a section of constant thickness which is shaped or otherwise;

the supporting and maintaining means have a section of varying thickness;

the supporting and maintaining means comprise a frame having a closed contour;

the supporting and maintaining means comprise independent elements disposed in the regions for gripping the sheet blank;

the supporting and maintaining means have an L-shaped section.

According to a further feature of the invention, the device comprises compensation elements.

A better understanding of the invention will be had from the following description which is given solely by way of example with reference to the accompanying drawings, in which.

Figure 1:
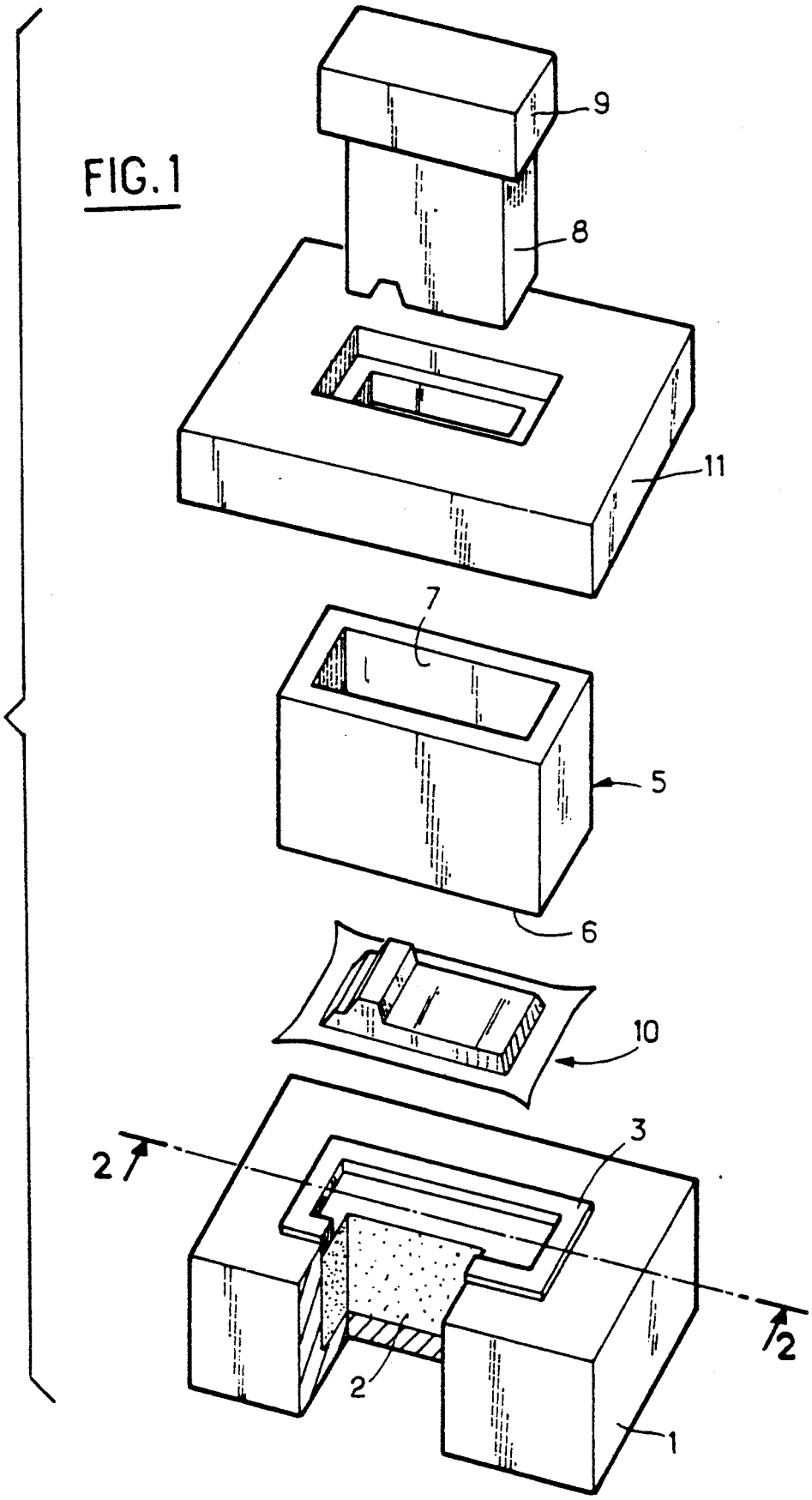
FIG. 1 is an exploded perspective view showing the different elements constituting the pressing device according to the invention.
Figure 2:
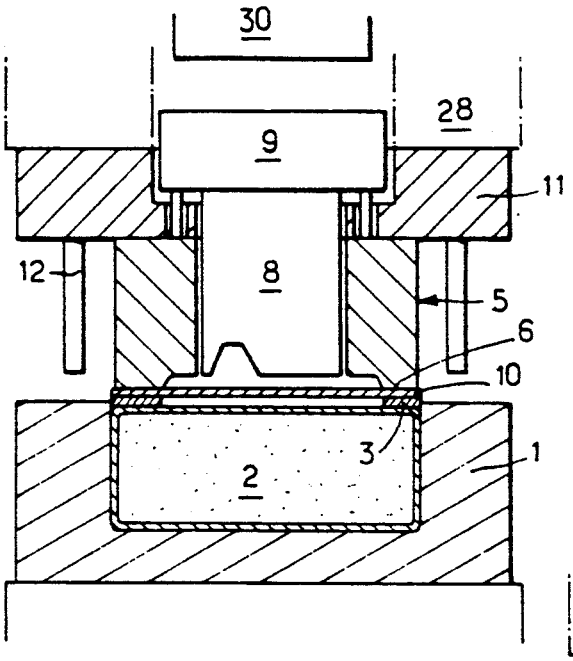
FIGS. 2 to 4 are sectional views taken on line 2—2 of FIG. 1, in the course of the successive steps for forming a part.
Figure 3:
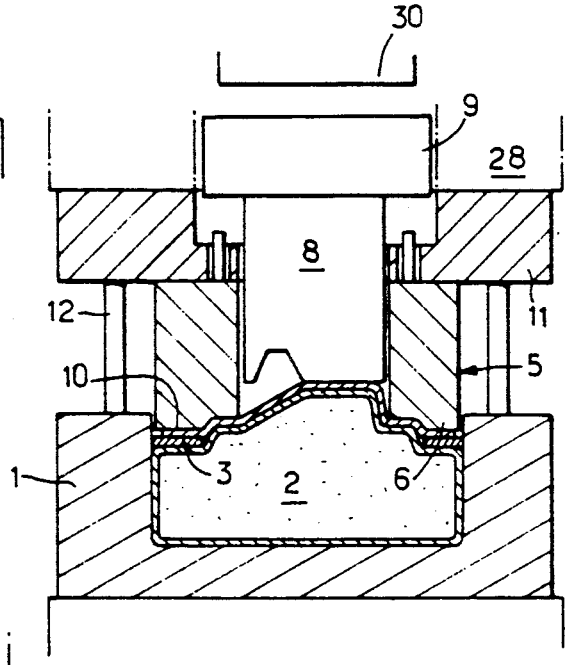

The pressing device shown in FIGS. 1 to 4 comprises a box 1 whose central part constitutes a recess for a cushion 2 composed of an elastic material.

Disposed on the upper surface of the elastic cushion 2 is a frame 3 having a closed contour and constituting a lower peripheral blank holder and substantially marrying up with the contour of the inner recess of the box 1 so as to be capable of entering said recess when forming the part.

The pressing device comprises above the box 1 a body 5 fixed to a raising member 11 carried by an outer slide 28. The lower part 6 of the body constitutes an upper peripheral blank holder.

The upper peripheral blank holder 6 has an outside perimeter slightly smaller than the contour of the inner recess of the box 1 so as to cooperate with the frame 3 and enter said recess.

The body 5 includes a central well 7 into which extends a punch 8 comprising a sole plate 9 in its upper part. The raising member 11 further comprises a central well for the passage of the punch 8 and the sole plate 9.

The lower side of the punch 8 comprises an impression corresponding to the profile of the finished part to be obtained.

A sheet blank 10 is formed in the following manner.

First of all, the sheet blank 10 is placed on the frame 3, then the outer slide 28 of the press (FIG. 2) comes into contact with the raising member 11. The outer slide 28 progressively descends and this causes, through the raising member 11, the descent of the body 5 and consequently the upper peripheral blank holder 6. The latter comes into contact with the sheet blank 10 whose peripheral portion is progressively gripped between the upper blank holder 6 and the frame 3 for the purpose of avoiding its festooning and at the same time compresses the elastic cushion 2 by reaction.

The elastic cushion 2, under the effect of this peripheral compression (FIG. 3), acts on the central region of the sheet blank 10 and effects the preforming of the blank.

The swelling of the central portion of the sheet blank is limited by the bottom of the punch 8 so as to avoid uncontrolled erratic deformations. The descent of the raising member 11 is limited by pillars 12.

Figure 4:
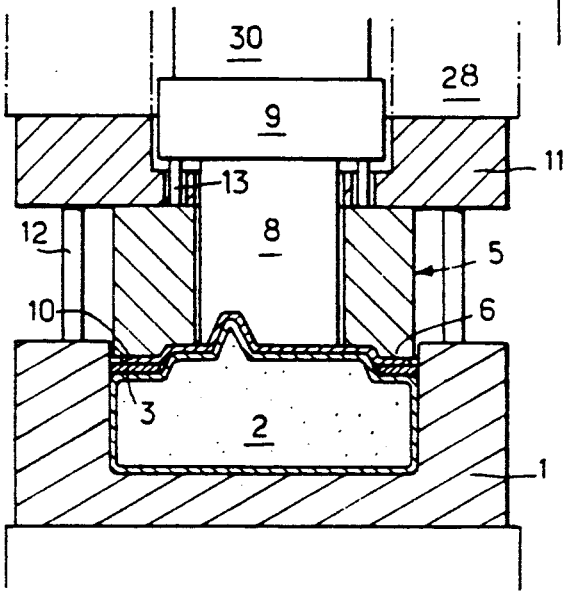
Figure 5:
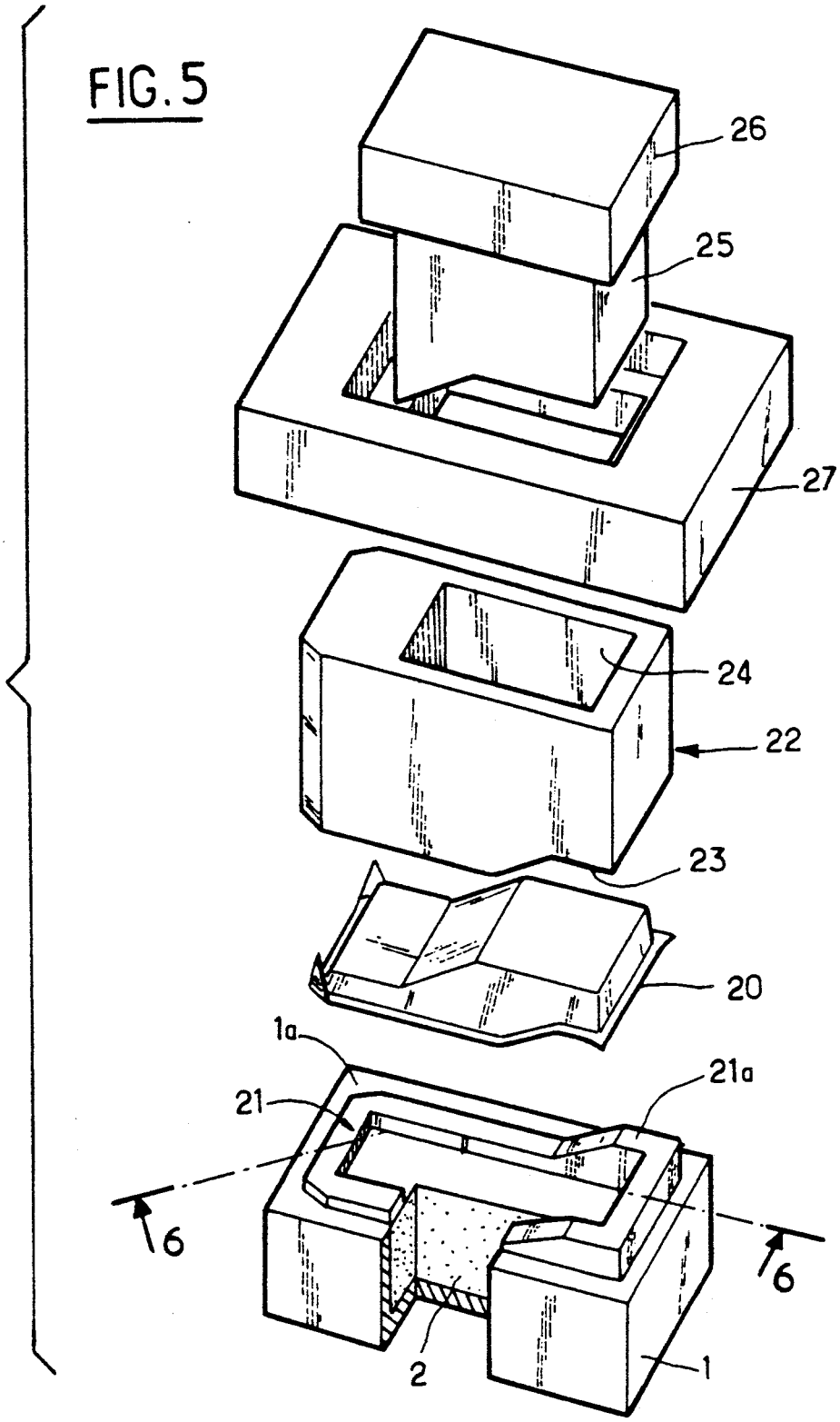
FIG. 5 is an exploded perspective sectional view of a first variant of the pressing device.
Figure 6:
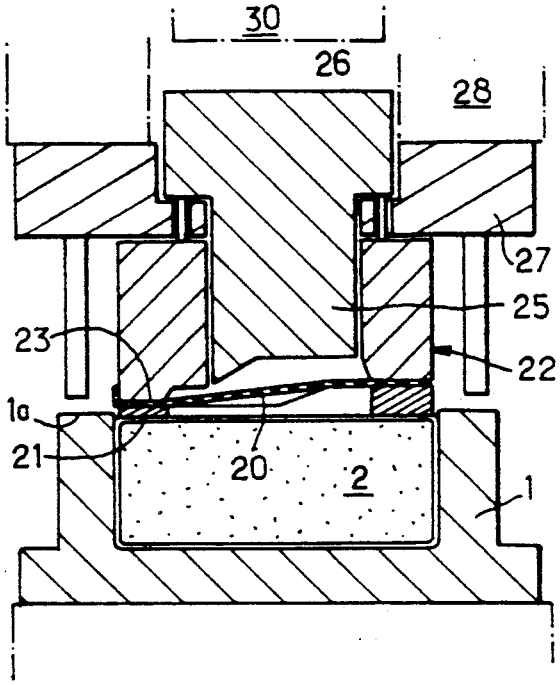
FIGS. 6 to 8 are sectional views taken on line 6—6 of FIG. 5, in the course of the successive steps for forming a part.
Figure 7:
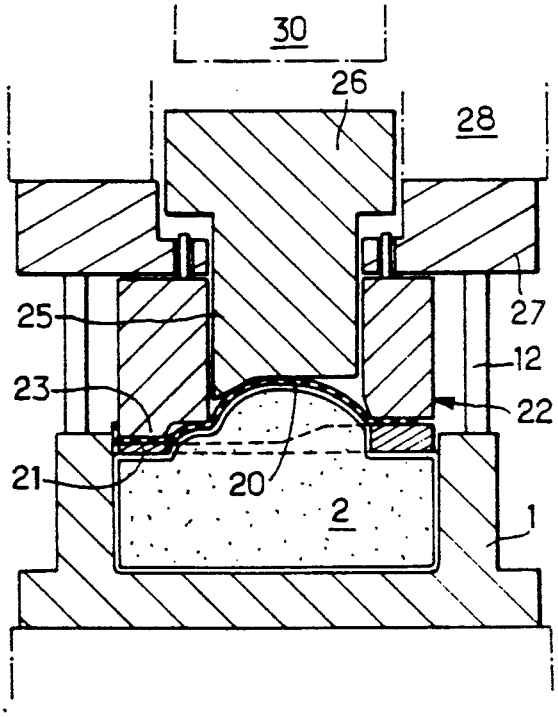
Figure 8:
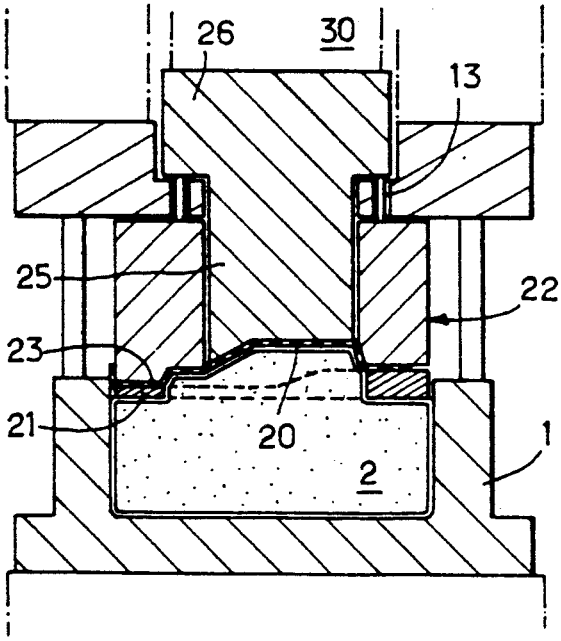

FIG. 4 shows the step for finally shaping the part. The central slide 30 of the press comes into contact with the sole plate 9 of the punch 8 and causes the descent of the punch to its lower position, and this punch at the same time shifts downwardly along therewith the upper peripheral blank holder 6 through rods 13 (FIG. 4) for the final forming of the sheet blank 10 which had been preformed in the preceding step.

The compression stresses due to the bearing of the punch 8 on the top of the sheet blank are converted under the action of the elastic cushion 2, acting on the opposite side of the sheet blank, into tensile stresses exerted throughout the area of the sheet blank and cause the displacement of the blank throughout the available volume.

The combination of the upper peripheral blank holder 6 and the lower peripheral blank holder formed by the frame 3 permits obtaining sufficient rigidity for maintaining the sheet blank in the region under the blank holder in the course of the preforming and final forming steps.

The step for releasing the finished part is effected by the simultaneous rising of the central slide 30 and the outer slide 28 which latter carries along therewith, through the raising member 11, the body 5 which in turn carries along therewith the punch 8 through the rods 13 and the sole plate 9.

According to a variant illustrated in FIGS. 5 to 8, the lower peripheral blank holder disposed on the elastic cushion 2 is formed by a frame 21 having a closed contour and defining a suitably shaped portion 21*a* corresponding to the profile of the peripheral region of the finished part to be obtained.

The device further comprises, as in the preceding variant, a body 22 carried by an outer slide 28 and having a lower part which constitutes an upper peripheral blank holder 23. The body 22 is provided with a well 24 into which extends a punch 25 which has on its lower side an impression corresponding to the profile of the finished part to be obtained. The punch 25 has a sole plate 26 in its upper part.

A raising member 27 is connected to the body 22 and also includes a central well for the passage of the punch 25.

Furthermore, predetermined regions 1*a* are provided on the upper surface of the box 1 which are cooperative with the upper peripheral blank holder 23 for effecting in localized regions a flanging of the edge portion of the sheet blank 20.

A sheet blank 20 is formed in the following manner.

First of all, the sheet blank 20 is placed in position and rests on the regions 1*a* and on the raised shaped portion 21*a* of the frame 21.

In a first stage, the outer slide 28 of the press (FIG. 6) acts on the body 22 through the raising member 27. The descent of the outer slide 28 is progressively continued so that the upper blank holder 23 of the body 22 causes a flanging in localized regions 1*a* of the edge portion of the sheet blank which is folded.

Consequently, in the course of this first step, localized regions of the peripheral portion of the sheet blank 20, which are subjected to a high shrinking, are maintained between the predetermined regions 1*a* and the blank holder 23 so as to effect in these regions the flanging of the edge portion of the sheet blank, thereby permitting a reduction in the volume of metal to be shrunk.

Thereafter, the descent of the outer slide 28 is continued for maintaining and forming the sheet blank 20 between the upper blank holder 23 and the lower blank holder constituted by the frame 21. Simultaneously, the elastic cushion 2 is compressed and, under the effect of this peripheral compression (FIG. 7), acts by a flowing of the cushion on the central region of the sheet blank 20 and preforms this blank.

The swelling of the central portion of the sheet blank is limited by the bottom of the punch 25 so as to avoid uncontrolled erratic deformations. As in the preceding variant, the descent of the raising member 27 and the outer slide 28 is limited by the pillars 29.

Thereafter, the central slide 30 of the press comes into contact with the sole plate 26 of the punch 25 and causes the descent of the latter which at the same time lowers the upper peripheral blank holder 23 through the rods 13 (FIG. 8) for the final forming of the central portion of the sheet blank 20.

Figure 9:
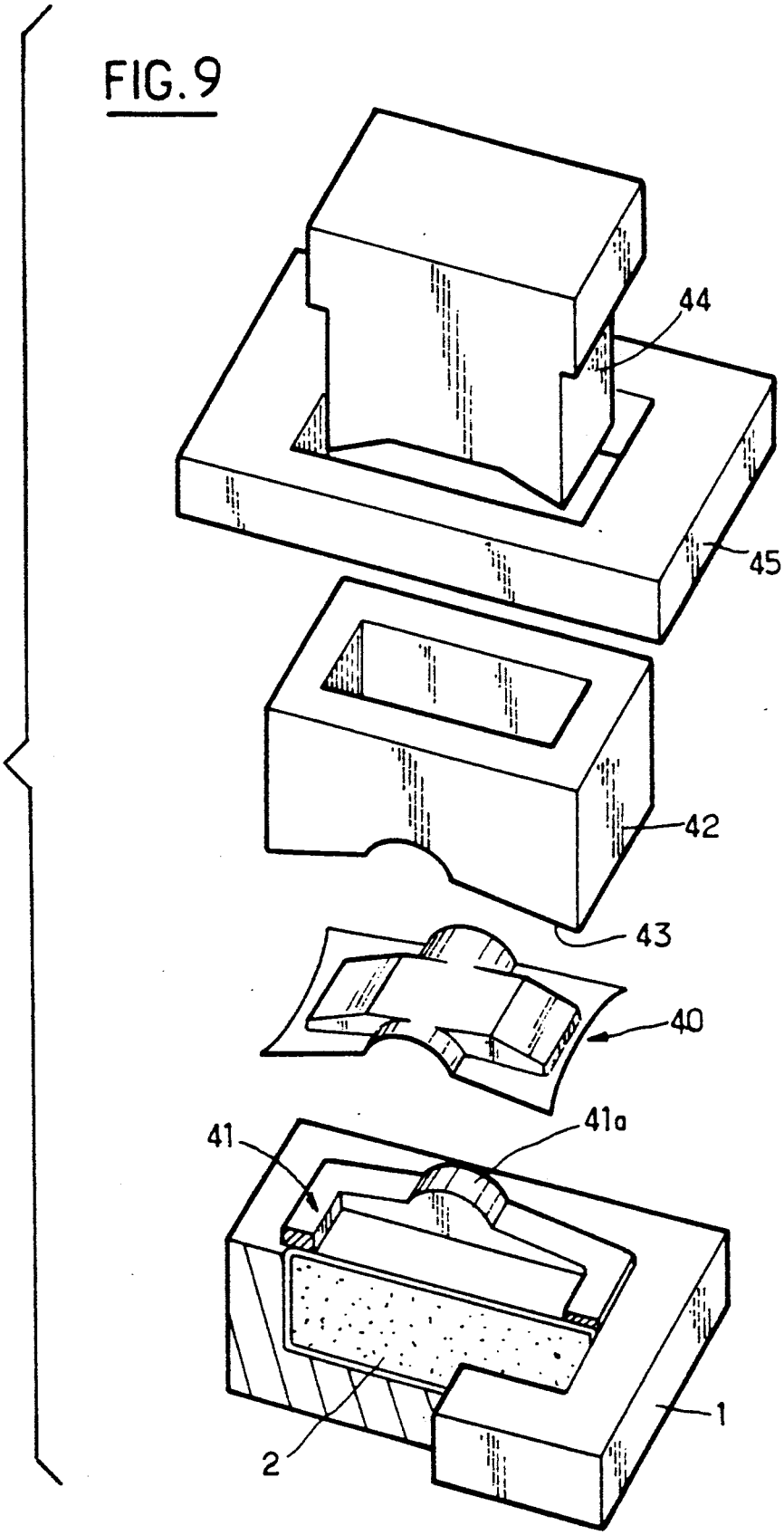
FIG. 9 is an exploded perspective view of a second variant of the pressing device.

According to another embodiment illustrated in FIG. 9, the lower peripheral blank holder disposed on the elastic cushion 2 is formed by a frame 41 which has in two opposed branches a shape in convex relief the height of which corresponds to the profile of the peripheral region of the final part 40 obtained after forming.

The device comprises, as in the preceding variants, a body 42 whose lower part forms the upper blank holder 43, a punch 44 and a raising member 45. The preforming and the final forming of the sheet are effected in the same manner.

Figure 10:
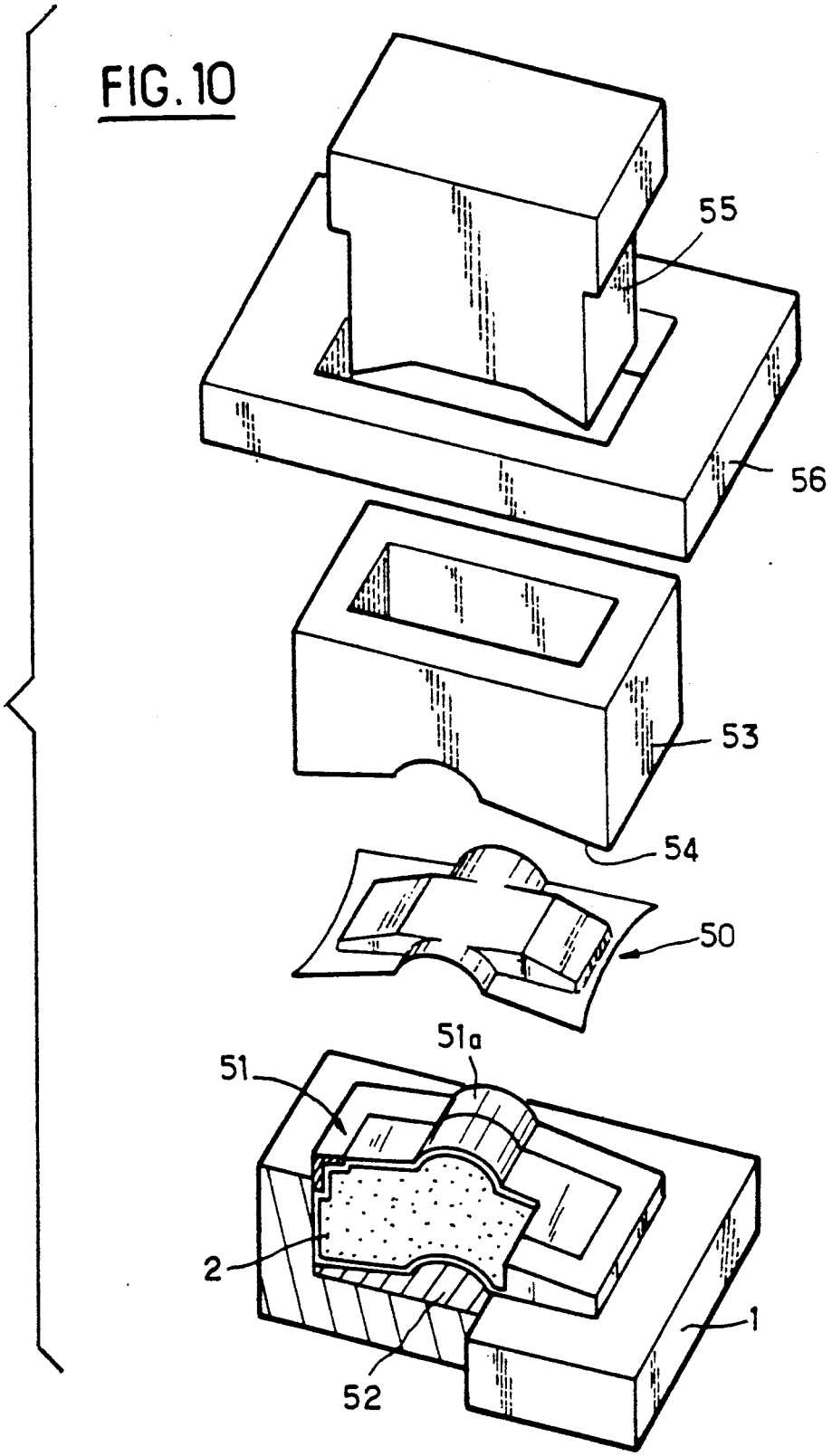
FIG. 10 is a perspective view of a third variant of the pressing device.

In another variant shown in FIG. 10, the lower peripheral blank holder disposed in the box 1 above the elastic cushion 2 is constituted by a frame 51 having an L-shaped cross-section. This frame 51 also has in two opposed branches a suitable shape 51*a* in convex relief.

When required, the device further comprises at least one compensation element. This compensation element has for purpose to reduce the volume between the upper surface of the elastic cushion 2 and the surface of the sheet blank gripped between the upper blank holder and the lower blank holder constituted by the frame, so as to cause the initiation of the preforming stage right at the start of the descent of the upper blank holder.

In the embodiment shown in FIG. 10, a compensation forming block 52 is interposed between the bottom of the box 1 and the elastic cushion 2. The compensation forming block 52 is in this case constituted by an incompressible block and has a profile substantially corresponding to the profile of the frame 51.

This arrangement permits preforming the elastic cushion 2 so that it marries up with the shape of the frame 51 and thereby avoids an excessive deformation of the elastic cushion when preforming and finally forming the part 50.

The device of course includes a body 53 whose lower part forms the upper blank holder 54, a punch 55, and a raising member 56.

Figure 11:
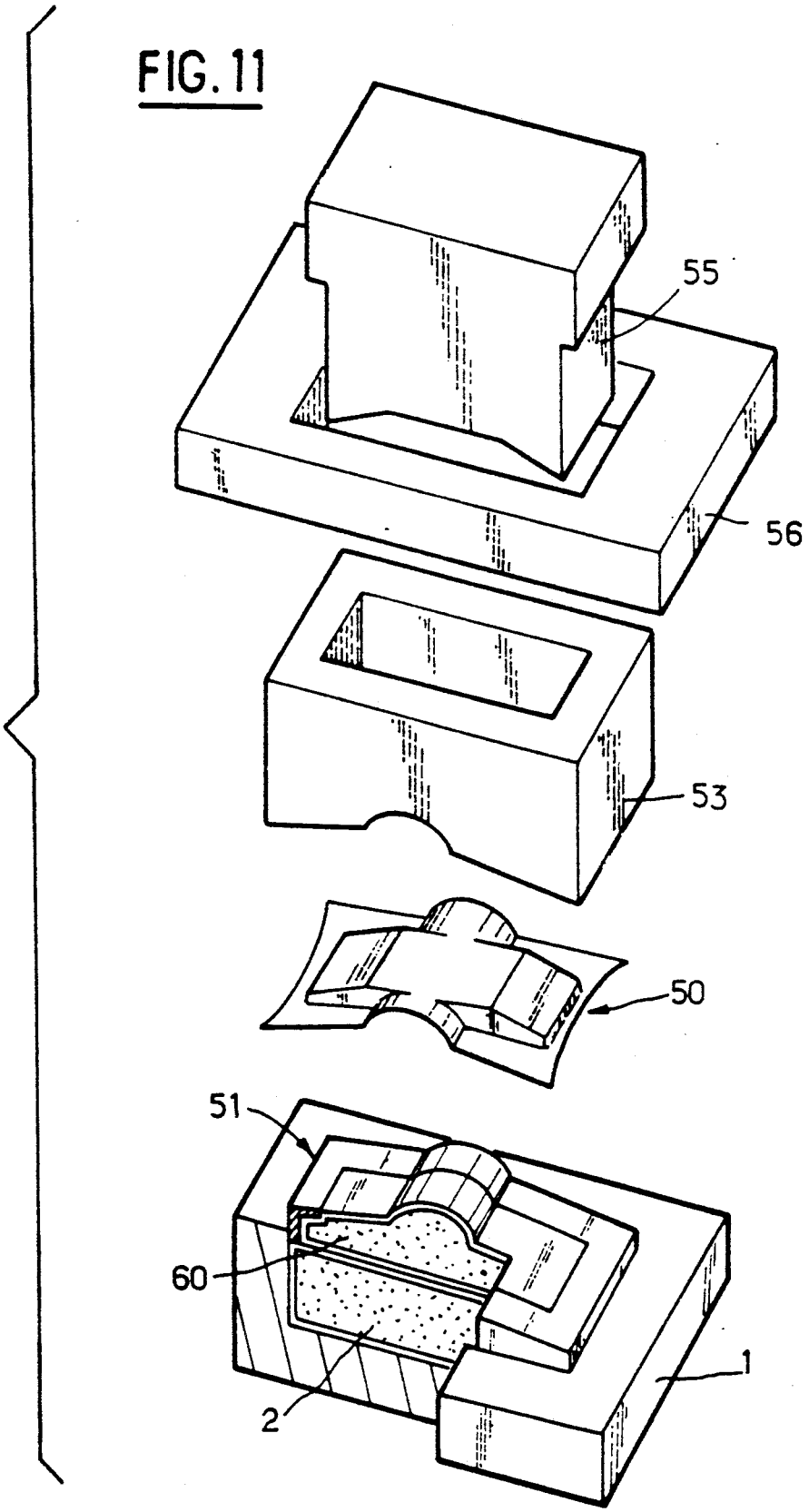
FIG. 11 is an exploded perspective view of a fourth variant of the pressing device.

According to another embodiment of the variant of FIG. 10, illustrated in FIG. 11, the lower peripheral blank holder is also constituted by a frame 51 having an L-shaped cross-section. However, in this case, the volume between the upper surface of the elastic cushion 2 and the frame 51 is filled by a compensation element 60. This compensation element is constituted by a small cushion composed of an elastic material of the same type as the cushion 2.

Also to be found in this variant are the body 53, the punch 55 and the raising member 56.

The compensation elements 52 and 60 therefore have for purpose to reduce the volume between the sheet and the elastic cushion and thereby cause the initiation of the preforming stage right at the start of the action of the upper blank holder on the ring.

Generally, the lower peripheral blank holder according to the invention has a shaped surface profile substantially corresponding to the profile of the peripheral region of the finished part to be obtained and a constant section thickness which is shaped or otherwise. It may also be employed as a system for ejecting the finished part.

Moreover, this lower blank holder may be formed by independent elements judiciously spaced apart on the perimeter of the elastic cushion and in regions where the peripheral region of the sheet blank must be clamped.

The device according to the invention therefore permits effectively maintaining the peripheral region of the part during the forming operations and improving the effectiveness and the life of the cushion of elastic material for producing pressed parts of medium depth but of large size, such as automobile parts whose central portions are practically never of shapes of revolution but represent non-developable complex shapes.

I claim:

1. A device for pressing a sheet material blank, in particular a sheet metal blank, comprising:
- a cushion comprising an elastic material,
- a retaining box surrounding the cushion,
- means for preforming the sheet blank comprising an outer slide, an upper blank holder operatively connected to the outer slide, and means for finally forming the sheet blank comprising a central slide, and a punch operatively connected to the central slide, and
- supporting and maintaining means for at least a portion of the sheet blank comprising a movable lower blank holder comprising a rigid structure wherein said lower blank holder is positioned directly on the elastic cushion and cooperates with the upper blank holder for gripping the sheet blank at least in localized regions thereof.

2. A device according to claim 1, wherein said lower blank holder comprises a shaped surface profile corresponding to a profile of a peripheral region of a finished part to be obtained.

3. A device according to claim 2, wherein said lower blank holder comprises a section of constant thickness.

4. A device according to claim 2, wherein said lower blank holder comprises a section of varying thickness.

5. A device according to claim 1, wherein said lower blank holder comprises a frame having a closed contour.

6. A device according to claim 1, wherein said lower blank holder comprises independent elements.

7. A device according to claim 1, wherein said lower blank holder comprises an L-shaped cross section.

8. A device according to claim 1, further comprising a compensation means located below said cushion.

9. A device according to claim 8, wherein the compensation means are disposed below the elastic cushion.

10. A device according to claim 9, wherein the compensation means comprise an incompressible block.

11. A device according to claim 8, wherein the compensation means are interposed between the supporting and maintaining means and the elastic cushion.

12. A device according to claim 11, wherein the compensation means comprise a small cushion composed of an elastic material of the same type as the aforementioned cushion.

13. A press forming device for pressing a sheet material blank into a finished part, comprising:
- an elastic cushion;
- a container having a recess which holds said elastic cushion;
- a first blank holder resiliently supported by said elastic cushion and adapted to selectively enter said container recess, said first blank holder comprising a rigid structure;
- a second blank holder which cooperates with said first blank holder for gripping a portion of the sheet material blank; and,
- a movable punch which selectively contacts the sheet material blank.

14. The device of claim 13 wherein said second blank holder comprises a peripheral edge of a body having a central well through which said punch moves to act on the sheet material blank.

15. The device of claim 14 further comprising a raising member which selectively urges said body in a first direction.

16. The device of claim 15 further comprising at least one pillar secured to said raising member and cooperating with said container for limiting a movement of said raising member in said first direction.

17. The device of claim 14 further comprising:
- a sole plate which is secured to said punch; and,
- through rods secured to said body, such that movement of said punch will cause said sole plate to contact said through rods and move said body.

18. The device of claim 13 wherein said first blank holder has a shaped upper surface corresponding to a profile of a peripheral region of a finished part to be obtained.

19. The device of claim 13, wherein said first blank holder comprises a frame member.

* * * * *